United States Patent [19]

Dallmer

[11] Patent Number: 4,978,250

[45] Date of Patent: Dec. 18, 1990

[54] DISCHARGE FITTING FOR A TILED FLOOR

[75] Inventor: Johannes Dallmer, Arnsberg, Fed. Rep. of Germany

[73] Assignee: Firma Dallmer GmbH & Co., Arnsberg, Fed. Rep. of Germany

[21] Appl. No.: 399,463

[22] PCT Filed: Jul. 12, 1988

[86] PCT No.: PCT/EP88/00627

§ 371 Date: Aug. 15, 1989

§ 102(e) Date: Aug. 15, 1989

[87] PCT Pub. No.: WO89/05889

PCT Pub. Date: Jun. 29, 1989

[30] Foreign Application Priority Data

Dec. 16, 1987 [DE] Fed. Rep. of Germany ..... 3742549
Feb. 13, 1988 [DE] Fed. Rep. of Germany ..... 3804596

[51] Int. Cl.[5] ..... E03F 5/04

[52] U.S. Cl. ..... 405/303; 137/362; 210/164; 405/36

[58] Field of Search ..... 405/36, 303; 404/2-5, 404/25, 26; 137/362, 363, 236.1; 210/163-165

[56] References Cited

U.S. PATENT DOCUMENTS

| | | | |
|---|---|---|---|
| 1,792,345 | 2/1931 | Williams | 137/362 X |
| 2,749,999 | 6/1956 | Schmid | 137/362 X |
| 3,299,785 | 1/1967 | James | 404/4 |

FOREIGN PATENT DOCUMENTS

| | | | |
|---|---|---|---|
| 0551161 | 1/1958 | Canada | 137/362 |
| 0551165 | 1/1958 | Canada | 137/362 |
| 3146275 | 6/1983 | Fed. Rep. of Germany | 137/362 |

*Primary Examiner*—Dennis L. Taylor
*Attorney, Agent, or Firm*—Henry M. Feiereisen

[57] ABSTRACT

The faces (33) of the plate into which the gully is cast, are extended all around by lattices (40) of glass fiber. These form a compound with the subsequently poured plaster floor so that a tension-proof connection is ensured when the tiles are fastened by an adhesive or mortar. According to a preferred embodiment, the plate may additionally be anchored in the plaster floor by reinforcement wire meshes (41) cast into said plate.

10 Claims, 2 Drawing Sheets

DISCHARGE FITTING FOR A TILED FLOOR

The invention relates to a discharge fitting for a tiled floor having a sink made of plastics material and being provided with a headpiece carrying a grate. The sink (gully) is cast in an integral cylinder of a plate made of concrete, preferably polyester concrete. At the surface of the plates, there are formed faces leading from the plate edges to the gully. A discharge fitting of this kind is known from German Offenlegungsschrift No. 36 27 807.

In such a discharge fitting, gully and concrete plate are a prefabricated unit which may be placed on the finished raw concrete. Recesses are formed in the concrete for the purpose of receiving the gully and the connecting pipes. Plaster floor may be applied around the plate on the concrete up to the level of the plate edge. This has as a result an automatically correct height adjustment of the gully and the plate surfaces inclined towards the gully present a geometrically exact foundation for a tile flooring having the required inclination.

The subject matter of the present invention is a further development of a discharge fitting of the kind described as regards a mechanically solid connection between the plate and the plaster floor being adjacent thereto.

This object is attained by the features of the main claim. The subclaims contain preferred embodiments.

In such a discharge fitting, a lattice of glass fibers is cast integral with the concrete plate during manufacture and is placed on the floor surrounding the plate when being applied to the floor. When the mortar or the adhesive material for the tiles has been applied, a tension-proof connection is achieved between the plate and the surroundings, because the lattice of glass fiber is bound in the compound material and such represents the foundation for the tile flooring. The formation of cracks in the joints is in particular avoided thereby.

According to a preferred embodiment of the invention, the concrete plate is continued at all sides by reinforcement wire meshes which form, after the bedding works, the connection between the concrete plate and the plaster floor. By the reinforcement wire meshes, a rigid connection in particular between the discharge fitting and the surrounding regions is produced. Thus, a shifting of the discharge fitting in particular in the case of unskilled bedding works is avoided. Preferably, four reinforcement wire meshes arranged cross-like are used which, during production of the concrete plate, may be placed laterally into a two-piece casting mold.

The anchoring of the reinforcement wire meshes with the discharge fitting may additionally be improved in that the reinforcement wire meshes are directly welded to the sink, provided that the latter consists of gray cast iron as known per se.

Figure 2:
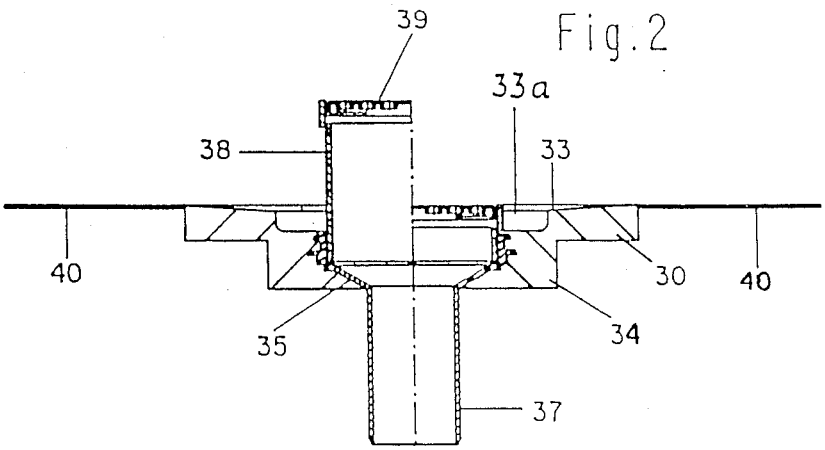
Figure 1:
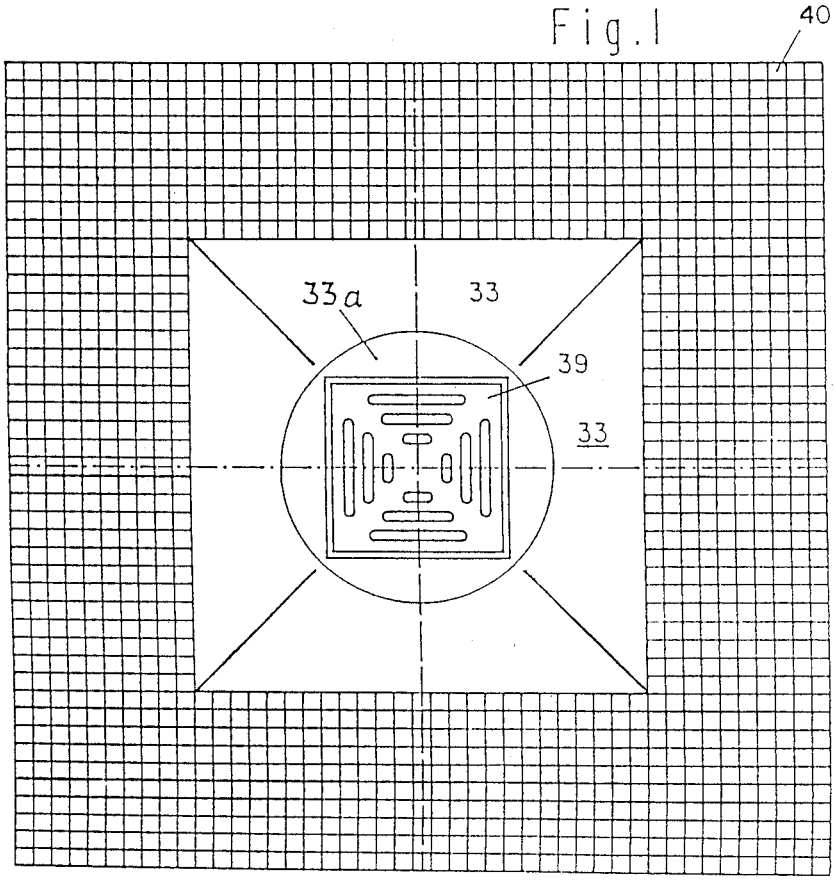
Figure 3:
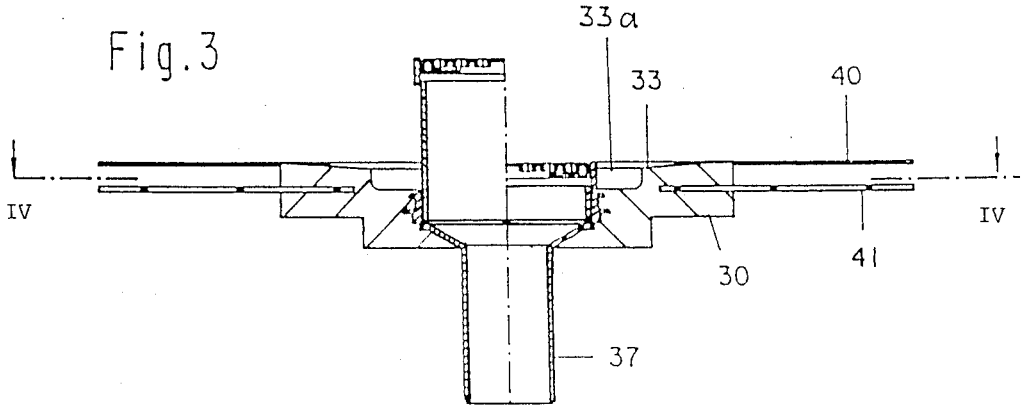
Figure 4:
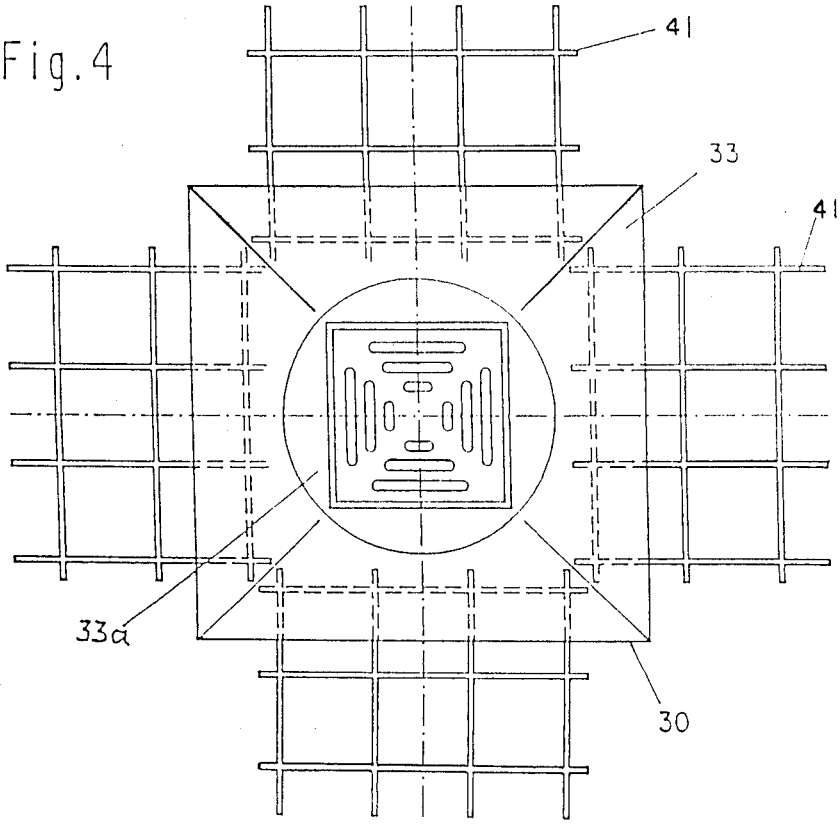

In the following text, the present invention is described in closer detail by means of embodiments and with reference to the accompanying drawings. Therein is:

FIG. 1 a plan view of the discharge fitting according to the invention;

FIG. 2 a vertical sectional view of the discharge fitting;

FIG. 3 a vertical sectional view of the discharge fitting according to another embodiment;

FIG. 4 a section on the line A-B of FIG. 3.

In this discharge fitting, a sink 35 (gully) made of plastics material and known per se is cast in a plate 30 of concrete, preferably polyester concrete. The concrete plate is square in plan view and bas faces 33 starting from the sides and being inclined towards the gully. The gully comprises a vertical discharge pipe 37. In the region of transition, the plate 30 is reinforced by an integrally formed cylinder 34. Besides, the gully may comprise odor sealing elements in a manner known per se. It has a headpiece 38 carrying a grate 39.

The sides of the square are extended all around by a lattice 40 of glass fibers, a solid connection being made between said lattice and the plate.

The discharge fitting is inserted in a corresponding recess of the local concrete. The discharge pipe is connected to the stationary discharge pipe line. The lattice lies on the concrete floor or the plaster floor, respectively. The tiled floor, which is not shown, is bedded with mortar or adhesively applied at such a level that the tiles close up to the grate. The headpiece 38 is adjusted to the corresponding level. When the tiles are laid the lattice is bound in the mortar or in the adhesive material, thus producing a foundation for the tiles which is able to receive tensional forces without any cracks being formed in the joints.

A further embodiment of the invention is shown by FIGS. 3 and 4. FIG. 3 shows that reinforcement wire meshes 41 are cast into the plate 30 of ployester concrete which extend laterally beyond this plate. These reinforcement wire meshes 41 serve the purpose of firmly anchoring the discharge fitting in the plaster floor which is subsequently poured. The reinforcement wire mesh 41 extends in a horizontal plane below the lattice 40. The plate 30 is thus prevented from shaking and damages to the tile layer to be applied by an adhesive is avoided. In the sectional view of FIG. 4, a preferred cross-like arrangement of four reinforcement wire meshes 41 is shown. In each case, approximately rectangular pieces of the reinforcement wire mesh 41 are cast into the plate 30 that the innermost transversal webs and longitudinal webs of four reinforcement wire meshes 41 form a square.

A circular depression 33a is provided adjacent to the side faces 33 which is concentrical with the sink 35 and which may receive the square part of the headpiece carrying the grate 39 in the case of a low adjustment of the headpiece 38 as shown on the right-hand side of FIGS. 2 and 3. The circular depression **33*a* makes it possible to adjust the square grate 39** by turning to the course of the tiles, also when the headpiece is only very low as shown in the drawings.

I claim:

1. A discharge fitting for a tiled floor, comprising:

a sink provided with a headpiece which carries a grate;

a plate adapted for receiving said sink and including surfaces directed toward said sink; and a lattice fixedly connected to said plate on all sides thereof for outwardly extending said surfaces of said plate all around, said lattice being placed on a floor so as to form a foundation for tiles to be subsequently attached by means of a suitable compound material, with said lattice being bound in the compound material in order to attain a tension-proof connection between said plate and the floor.

2. A discharge fitting as defined in claim 1 wherein said lattice is made of glass fibers.

3. A discharge fitting as defined in claim 1, and further comprising reinforcement wire meshes cast into said plate and extending horizontally below said lattice for anchoring purposes.

4. A discharge fitting as defined in claim 3 wherein four reinforcement wire meshes are arranged cross-like.

5. A discharge fitting as defined in claim 1 wherein said plate includes a circular depression for receiving a square part of said headpiece.

6. A discharge fitting as defined in claim 1 wherein said sink is made of plastic material.

7. A discharge fitting as defined in claim 1, and further comprising a cylinder integrally formed with said plate for reinforcing said plate, said sink being cast in said cylinder.

8. A discharge fitting as defined in claim 1 wherein said plate is made of concrete.

9. A discharge fitting as defined in claim 8 wherein said plate is made of polyester concrete.

10. A discharge fitting as defined in claim 1 wherein the plate is square in plan view in order to match the contour of the tiles.

* * * * *